US006948998B2

(12) United States Patent
Bagley

(10) Patent No.: US 6,948,998 B2
(45) Date of Patent: Sep. 27, 2005

(54) INTERCONNECTABLE MODEL CONSTRUCTION ELEMENTS

(76) Inventor: Jim Bagley, P.O. Box 27823, West Valley City, UT (US) 84127

( * ) Notice: Subject to any disclaimer, the term of this patent is extended or adjusted under 35 U.S.C. 154(b) by 0 days.

(21) Appl. No.: 10/775,535

(22) Filed: Feb. 9, 2004

(65) Prior Publication Data

US 2004/0224601 A1 Nov. 11, 2004

Related U.S. Application Data

(60) Provisional application No. 60/445,934, filed on Feb. 7, 2003.

(51) Int. Cl.[7] ..... A63H 33/08
(52) U.S. Cl. ..... 446/124; 446/104; 446/85
(58) Field of Search ..... 446/102–104, 446/120–126, 93–96, 85

(56) References Cited

U.S. PATENT DOCUMENTS

| | | | | | |
|---|---|---|---|---|---|
| 1,198,263 | A | | 9/1916 | Pajeau | |
| 1,851,159 | A | | 3/1932 | Dodge | |
| 3,233,358 | A | | 2/1966 | Dehm | |
| D219,230 | S | | 11/1970 | Martinus et al. | |
| 3,550,311 | A | | 12/1970 | Fouquart | |
| 3,552,257 | A | | 1/1971 | Tanabe | |
| 3,648,404 | A | | 3/1972 | Ogsbury et al. | |
| 3,690,656 | A | | 9/1972 | Hughes et al. | |
| 3,698,123 | A | | 10/1972 | Heldt | |
| 3,808,737 | A | | 5/1974 | Abrams | |
| 3,927,489 | A | | 12/1975 | Bernstein | |
| 4,078,328 | A | | 3/1978 | Rayment | |
| D254,752 | S | | 4/1980 | Gabriel | |
| 4,548,590 | A | | 10/1985 | Green | |
| 4,606,732 | A | | 8/1986 | Lyman | |
| 4,758,196 | A | * | 7/1988 | Wang | 446/104 |
| 4,886,477 | A | * | 12/1989 | Ziegler | 446/104 |
| 4,992,069 | A | * | 2/1991 | Bolli et al. | 446/128 |
| 5,044,960 | A | | 9/1991 | De Porteous | |
| 5,049,105 | A | * | 9/1991 | Glickman | 446/126 |
| 5,096,352 | A | | 3/1992 | Lemelson | |
| 5,137,486 | A | | 8/1992 | Glickman | |
| 5,172,534 | A | * | 12/1992 | Milner et al. | 52/632 |
| D334,953 | S | | 4/1993 | Kawahara et al. | |
| 5,199,919 | A | | 4/1993 | Glickman | |
| 5,209,693 | A | * | 5/1993 | Lyman | 446/104 |
| 5,304,086 | A | * | 4/1994 | Bolli et al. | 446/108 |
| 5,368,514 | A | | 11/1994 | Glickman et al. | |
| 5,383,715 | A | | 1/1995 | Homma et al. | |
| 5,487,691 | A | | 1/1996 | Chiu | |
| D367,897 | S | | 3/1996 | Schmidt et al. | |
| 5,503,497 | A | * | 4/1996 | Dudley et al. | 403/103 |

(Continued)

FOREIGN PATENT DOCUMENTS

| | | | | |
|---|---|---|---|---|
| DE | 10208834 A1 | * | 9/2003 | F16B/7/00 |
| EP | 1068886 A2 | * | 1/2001 | A63H/33/08 |
| JP | 10127953 A | * | 5/1998 | A63H/33/08 |
| WO | WO 97/45183 | | 12/1997 | |

*Primary Examiner*—Derris H. Banks
*Assistant Examiner*—Urszula M. Cegielnik
(74) *Attorney, Agent, or Firm*—Morriss O'Bryant Compagni

(57) ABSTRACT

A system of interconnectable construction elements created from molded plastic, wood or metal, and which include four basic construction elements, wherein a first and second construction element include a hemispherical segment and a planar connecting segment and complementary male and female connectors, and third and fourth construction elements that include a hemispherical segment with complementary male and female connectors, wherein the first and second construction elements can be coupled together, the third and fourth construction elements can be coupled together, or one of the first and second construction elements can be coupled to a complementary one of the third or fourth construction elements.

34 Claims, 13 Drawing Sheets

U.S. PATENT DOCUMENTS 5,527,201 A 6/1996 Maddock
5,645,463 A * 7/1997 Olsen ..... 446/104
D394,091 S 5/1998 Parry
5,769,681 A * 6/1998 Greenwood et al. ..... 446/120
5,871,384 A * 2/1999 Kichijo ..... 446/112
D409,677 S 5/1999 Jensen
5,904,606 A 5/1999 Zimmer et al.
5,928,051 A 7/1999 Krog
5,984,756 A 11/1999 Krog
6,672,931 B1 * 1/2004 Bagley ..... 446/106

* cited by examiner

INTERCONNECTABLE MODEL CONSTRUCTION ELEMENTS

CROSS REFERENCE TO RELATED APPLICATIONS

This document claims priority to provisional patent application Ser. No. 60/445,934, filed Feb. 7, 2003.

BACKGROUND OF THE INVENTION

1. Field of the Invention

This invention relates generally to construction and model building toys. Specifically, the invention is a system of construction elements that are coupled together to form various shapes and models. The construction elements are capable of being interconnected and configured to form interesting, educational, and entertaining designs, models, and construction projects. The nature of the construction elements also enables movement of some construction elements relative to other construction elements when coupled together.

2. Description of Related Art

The state of the prior art is replete with building blocks and other similar types of toys that enable construction elements to be coupled together to build models, shapes, patterns or designs in three dimensions. While these construction elements are referred to as toys, it should not be assumed that they are simplistic devices. The construction elements are capable of building complex shapes and models. Furthermore, they often include the ability to incorporate actuable elements such that they can be powered by mechanical or electrical devices, or even by manual manipulation. The result is that the construction elements are often minor engineering feats in and of themselves.

Given this introduction to so-called toy construction elements, it should not be surprising to realize that construction elements are capable of rather amazing and even ingenious ways of interlocking to thereby form rather complex models, shapes, patterns and designs.

However, given the fact that there are many different types of construction elements, and that there are many different types of connection schemes that can be used to connect them, it should also not be surprising that new and advantageous construction elements and ways of connecting them together are still possible.

Accordingly, it would be advantageous to provide a plurality of building elements that include new and advantageous means of building construction projects, models, shapes, patterns or designs, wherein only a small number of construction elements are capable of being combined in a variety of ways to enable an imaginative user to build both simple and complex projects. Finally, it would be advantageous to provide a plurality of construction elements that can be actuated so as to pivot, rotate, and otherwise move relative to each other by application of mechanical force to thereby animate the construction projects, models, shapes, patterns or designs.

BRIEF SUMMARY OF THE INVENTION

It is an object of the present invention to provide a new system of interconnectable construction elements that enable advantageous coupling therebetween.

It is another object to provide a new system of interconnectable construction elements wherein a strut member is comprised of two sides that can be coupled together to form a complete strut member.

It is another object to provide a new system of interconnectable construction elements wherein the two sides or halves of the strut members are not identical.

It is another object to provide a new system of interconnectable construction elements wherein the two sides of the strut members can be coupled together, and still allow a planar strut member to be disposed therebetween so as to become an integral part of the coupled strut members.

It is another object to provide a new system of interconnectable construction elements wherein the strut members include two hemispherical segments that are coupled by a connecting member.

It is another object to provide a new system of interconnectable construction elements wherein the strut members can also include a C-claw shape coupled to at least one of the two hemispherical segments.

It is another object to provide a new system of interconnectable construction elements wherein the hemispherical segments include guiding or channeling structures thereon such that construction elements capable of pivoting motion will pivot along a plane defined by the channeling structures.

It is another object to provide a new system of interconnectable construction elements wherein a strut member includes a gap between the two hemispherical segments that enable complementary structures to be inserted therethrough so as to couple to the strut member.

It is another object to provide a new system of interconnectable construction elements wherein a strut member can be manufactured with a variety of different attaching means on ends thereof to enable the strut member to couple to a variety of complementary structures.

It is another object to provide a new system of interconnectable construction elements wherein a strut member is a relatively planar structure.

It is another object to provide a new system of interconnectable construction elements wherein the planar strut member includes apertures along a length thereof at regularly spaced intervals.

It is another object to provide a new system of interconnectable construction elements wherein a planar strut member having at least one aperture through a length thereof includes a plurality of dentations and indentations to thereby enable coupling between construction elements.

It is another object to provide a new system of interconnectable construction elements wherein the construction elements can be coupled to each other in such a way that application of mechanical force to the construction elements can animate a construction project, model, shape, pattern or design.

The above objects are realized in a specific illustrative embodiment of a system of interconnectable construction elements created from molded plastic, wood or metal, and which include four basic construction elements, wherein a first and second construction element include a hemispherical segment and a planar connecting segment and complementary male and female connectors, and third and fourth construction elements that include a hemispherical segment with complementary male and female connectors, wherein the first and second construction elements can be coupled together, the third and fourth construction elements can be coupled together, or one of the first and second construction elements can be coupled to a complementary one of the third or fourth construction elements.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

The presently preferred embodiment of the invention has again evolved substantially since its inception. Therefore, as the invention is explained, it is important to keep in mind that the various construction projects, models, shapes, patterns or designs that can be created using the construction elements of the invention are numerous. Accordingly, the examples given hereinafter are only able to give a very brief introduction to many design possibilities. The purpose of the inventor was to free the user to create models, shapes, patterns or designs that are limited by the user=s imagination, and not by the construction elements themselves.

The construction elements are generally manufactured from molded plastic as is commonly found in toys for children. The plastic is relatively rigid, but will bend or give slightly in order for construction elements to engage each other via friction or a snap connection. In other words, the construction elements will generally snap together, but may be required to slightly bend in order to insert or attach one construction element to another. Furthermore, it is an important aspect of the present invention that the construction elements are now primarily formed by snapping together two sides or halves to form a non-construction element that is hemispherical in nature. Thus, one side of the construction element is generally planar, and the opposite side is generally hemispherical.

In addition, other materials can be used for the construction elements. For example, wood and metal are also suitable materials. Each material has properties which can lend themselves to particular applications. Accordingly, the materials that can be used are generally all those which can for the desired construction elements, as is known to those skilled in the art.

With this brief introduction, the elements of the presently preferred embodiment will now be described. The main construction element of the present invention is a strut member. The strut members of the embodiments of the present invention are divided into three distinct types, as will be shown. Furthermore, all strut members are formed as having either a male connector or a complementary female connector so that the different halves can be joined by male and female connectors that snap together.

Figure 1A:
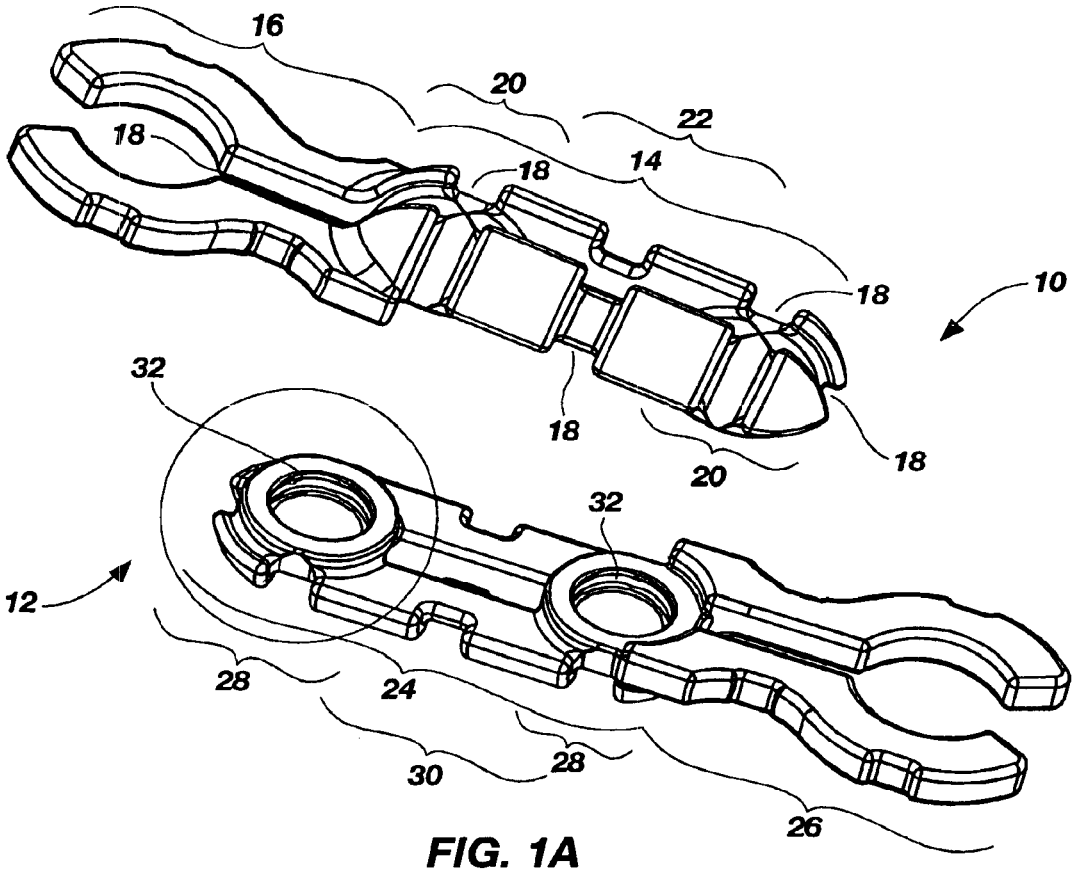
FIG. 1A is a perspective view of a two partially hemispherical and partially planar construction elements.

FIG. 1A shows two construction elements 10 and 12. The first construction element 10 is shown having a hemispherical segment 14, and a planar segment 16. The planar segment 16 has a C-claw disposed on a first end. The hemispherical segment 14 is shown from a perspective that enables viewing of the hemispherical side of the first construction element 10.

Important features to note are the various slots 18 on the first construction element 10 that enable other construction elements to be coupled to it in a rigid manner, or in a manner that enables sliding engagement. The hemispherical segment 14 also includes two hemispheres 20 that are shown being coupled via a two joining segments 22.

It is noted that while there are two joining segments because of a slot disposed between them, a single joining segment could be used.

Also in FIG. 1A is the complementary half or second construction element 12. The second construction element 12 is comprised of a hemispherical segment 24, and a planar segment 26. The hemispherical segment 24 includes two hemispheres 28 that are coupled by two joining segments 30. It is noted that slots can also be disposed as indented slots in the two hemispheres 28, wherein the indented slots can be parallel to a long axis of the construction element 10, or perpendicular to the long axis.

The first and second construction elements 10, 12 can be coupled together in a first manner by snapping together the two hemispherical segments 14, 24. Specifically, the hemispheres 28 of the second construction element 12 include a cavity therein for forming female connectors 32. The first construction element 10 includes complementary connecting features that form male connectors to be shown in FIGS. 1C and 1D.

Figure 1B:
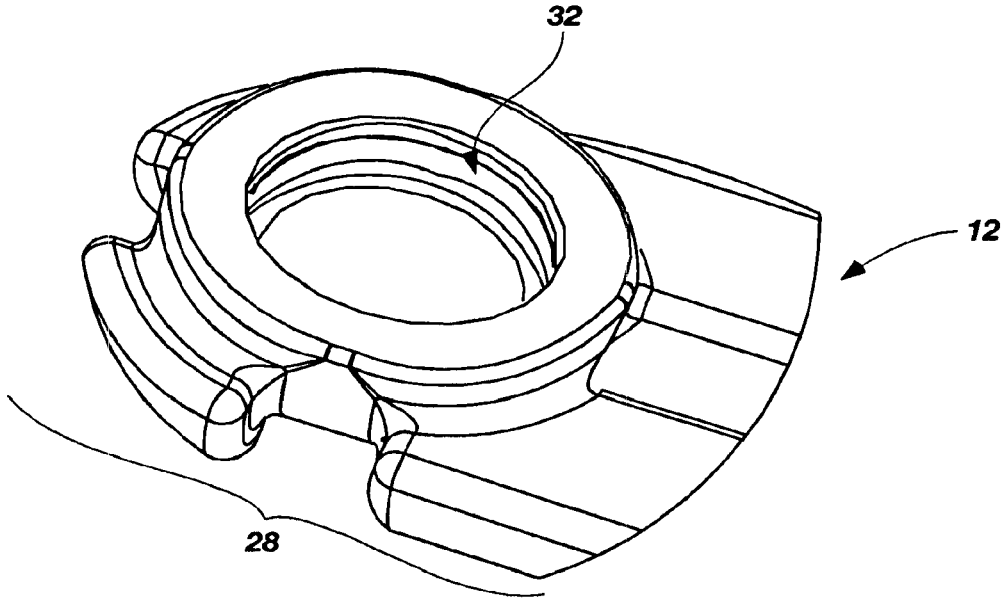
FIG. 1B is a close-up of detail of a connecting end on a partially hemispherical segment of a construction element in FIG. 1A.

FIG. 1B is provided as a close-up of the hemisphere 28 that is disposed on an end of the second construction element 12.

Figure 1C:
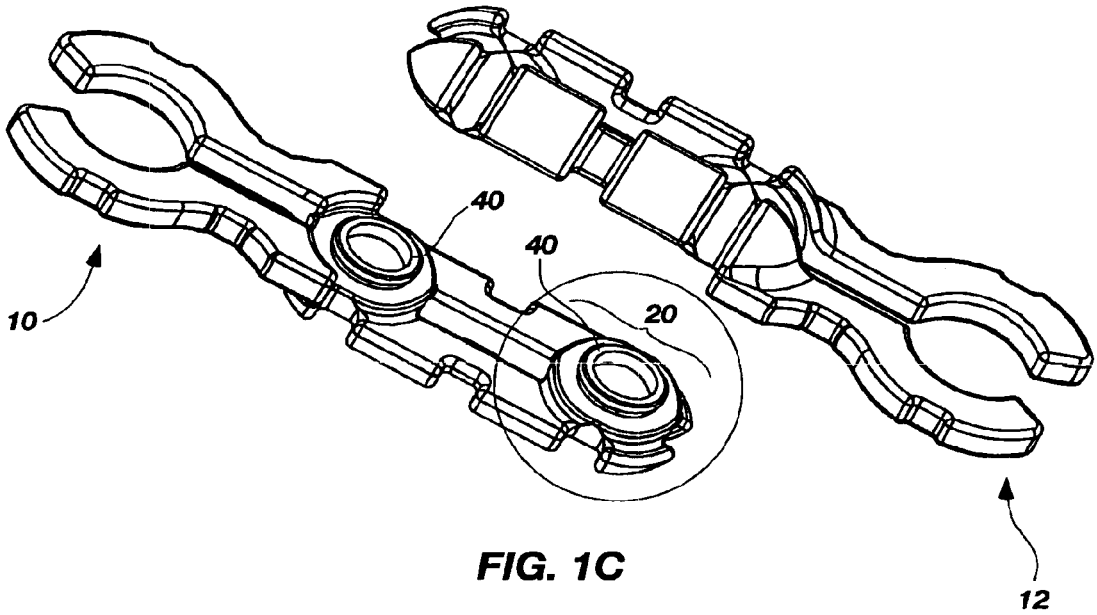
FIG. 1C is a perspective view of the other side of the two partially hemispherical and partially planar construction elements in FIG. 1A.

FIG. 1C shows the two construction elements 10 and 12 from FIG. 1A. The first construction element 10 is now seen from its opposite side so that complementary connecting features that form male connectors 40 are now visible. The male connectors 40 are designed to make a snap fit with the female connectors 32. The male connectors are essentially a raised and circular lip that is designed to fit into a groove within a circular aperture of the female connectors 32. The resulting construction element that is formed by snapping the first and second construction elements 10, 12 together is a strut having a C-claw at each end, and a cylindrical segment inbetween, as will be shown in other figures.

Figure 1D:
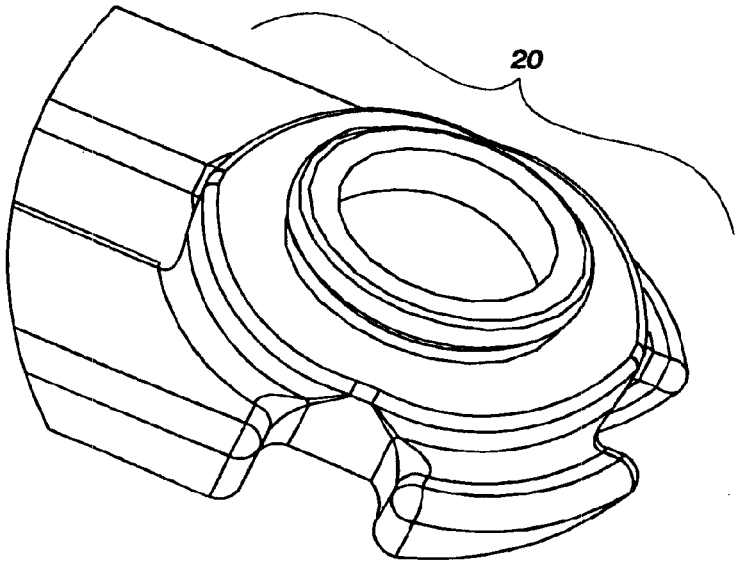
FIG. 1D is a close-up of detail of a connecting end on a partially hemispherical segment of a construction element in FIG. 1C.

FIG. 1D is provided as a close-up of the hemisphere 20 that is disposed on an end of the first construction element 10.

Another important feature to recognize is that the planar segments 14, 26 are offset from a plane made by the two joining segments 22, 30. The planar segments 14, 26 can be considered to be raised above the plane made by the joining segments 22, 30. Because of this offset, when any two construction elements 10, 12 are coupled together, the C-claws are thus centered along a cylinder formed by the hemispherical segments 14 and 24.

Figure 2A:
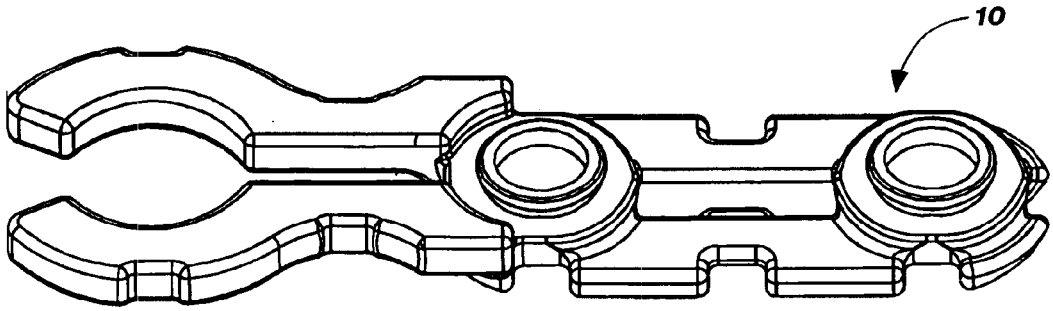
FIG. 2A is a perspective view of a partially hemispherical and partially planar construction element from FIG. 1C.

FIG. 2A is a perspective view of the first construction element 10 from FIG. 1A. It is provided as a contrast to a third construction element.

Figure 2B:
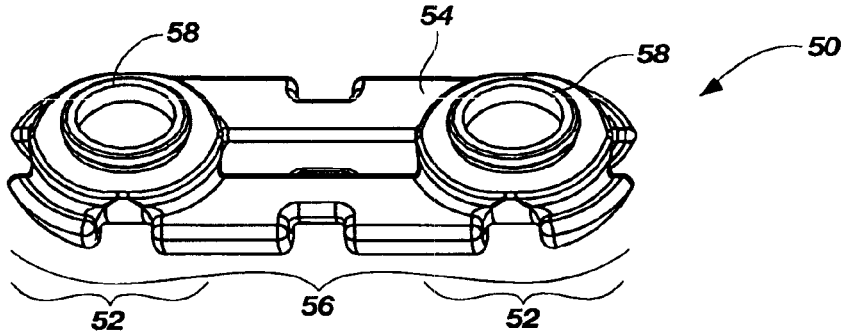
FIG. 2B is a perspective view of a different construction element that is hemispherical.

FIG. 2B is a perspective view of the third construction element 50. The third construction element is comprised of a single hemispherical segment 56 having hemispheres 52 at each end thereof, and a connecting member 54 disposed therebetween. The male connectors 58 are designed to make a snap fit connection, for example, with corresponding female connectors 68 shown in FIG. 2D.

Figure 2C:
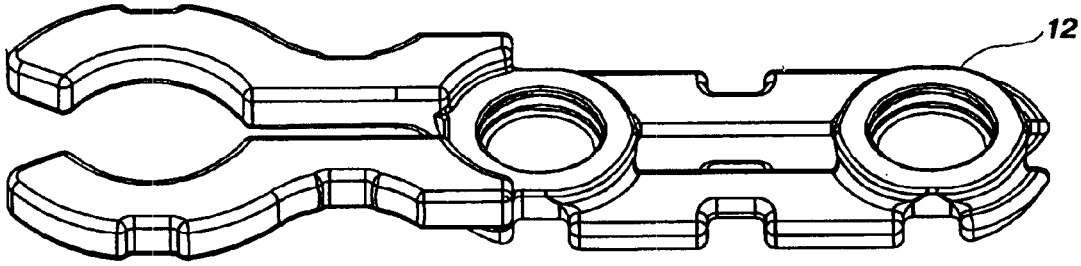
FIG. 2C is a perspective view of a partially hemispherical and partially planar construction element from FIG. 1A.

FIG. 2C is a perspective view of the first construction element 12 from FIG. 1A. It is provided as a contrast to a fourth construction element 60.

Figure 2D:
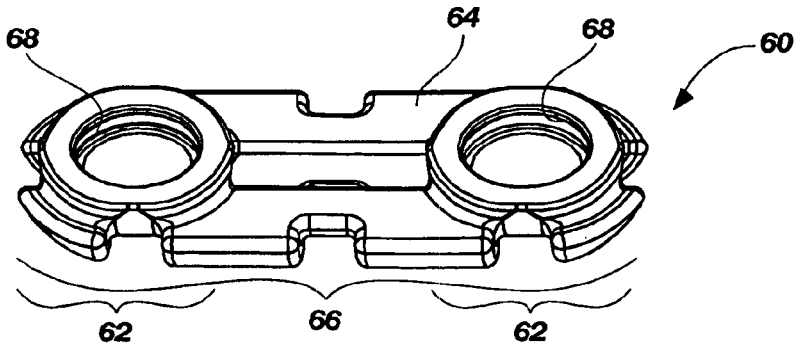
FIG. 2D is a perspective view of a different construction element that is hemispherical.

FIG. 2D is a perspective view of the third construction element 60. The third construction element is comprised of a single hemispherical segment 66 having hemispheres 62 at each end thereof, and a connecting member 64 disposed therebetween. The female connectors 68 are designed to make a snap fit connection, for example, with corresponding male connectors 58 shown in FIG. 2D.

While it has been suggested that the third and fourth construction elements can be coupled together, it should also be apparent that the first construction element 10 can be coupled to the fourth construction element 60, and the second construction element 12 can be coupled to the third construction element 50.

Furthermore, it should be stated that it is not required that the two male connectors 40 of the first construction element 10 be coupled to the two female connectors 68 of the fourth construction element 60. For example, only a single hemisphere 20 of the first construction element 10 could be coupled to a single hemisphere 62 of the fourth construction element 60. In that way, the fourth construction element 60 could be coupled at its unattached hemisphere 60 to another complementary construction element.

Figure 3A:
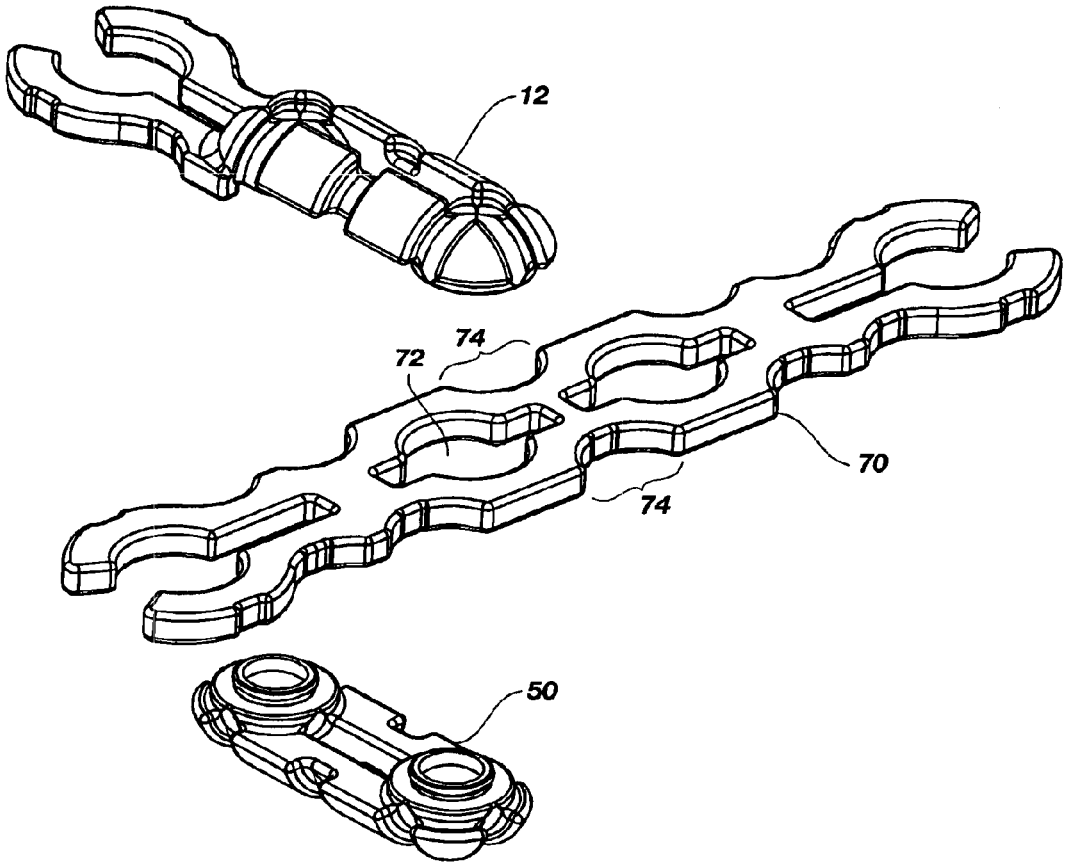
FIG. 3A is a perspective view of three construction elements that are to be coupled together.

FIG. 3A is provided as a perspective view of three construction elements. The second construction element 12 is shown above and perpendicular relative to a planar construction element 70 having various apertures disposed therethrough. One aperture id designated as item 72. The third construction element 50 is shown disposed below the planar construction element 70.

Figure 3B:
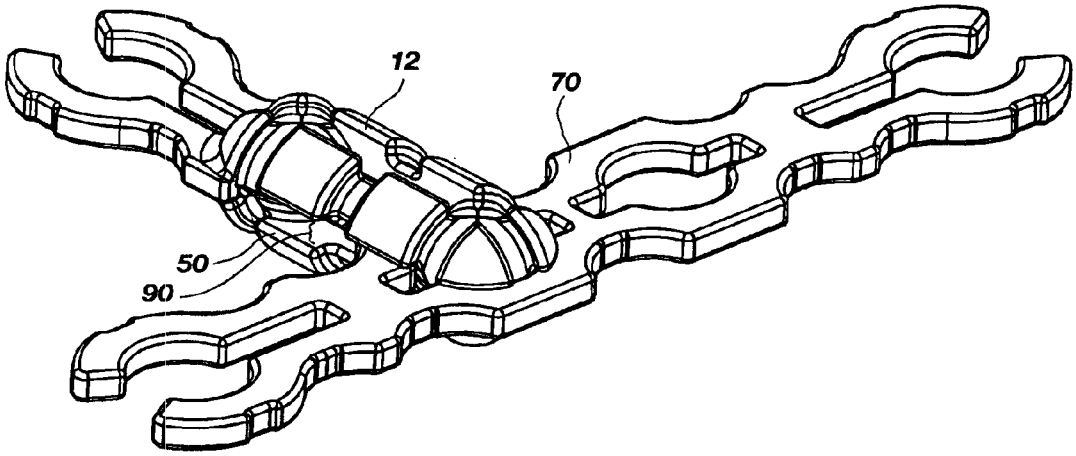
FIG. 3B is a perspective view of the three construction elements of FIG. 3A after they are coupled together.

FIG. 3B is a perspective view illustrating one possible configuration for coupling the three construction elements 12, 50, 70 together. Note that the second and third construction elements 12, 50 are snapped together through the aperture 72.

Figure 4:
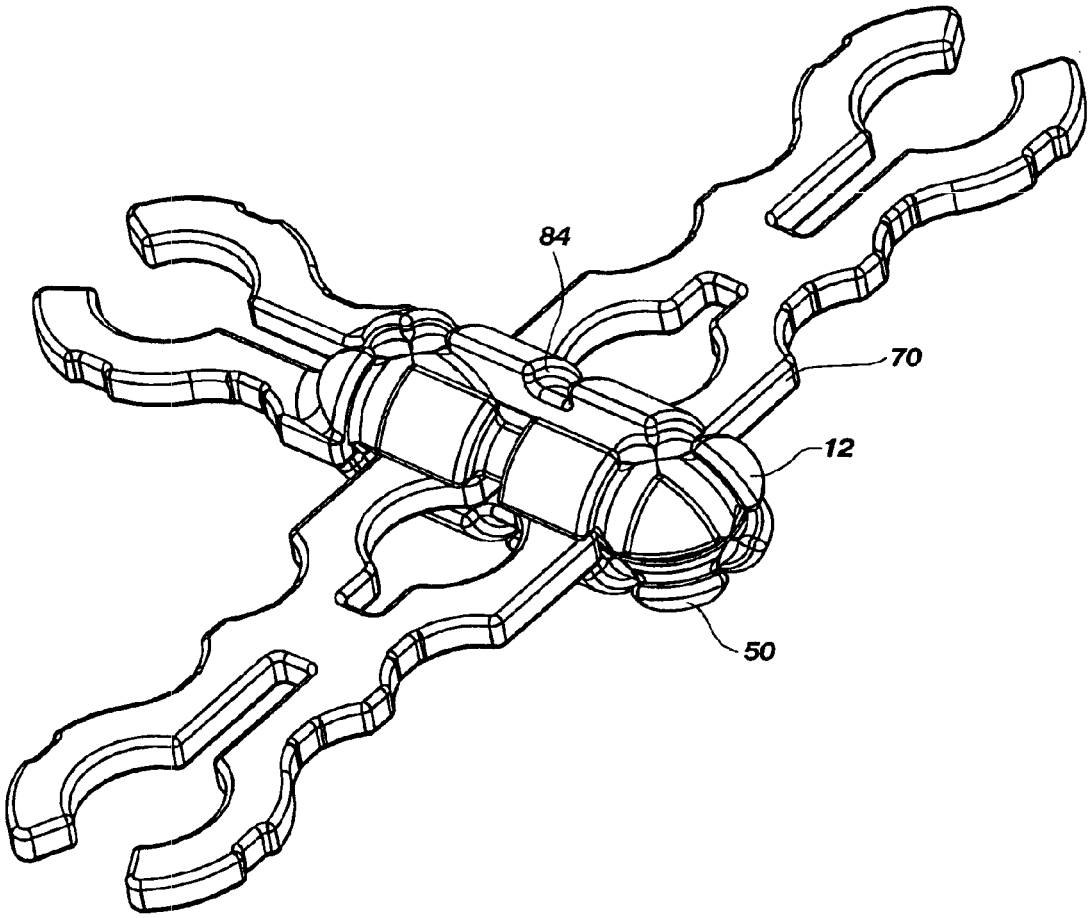
FIG. 4 is a perspective view of the three construction elements of FIG. 3A, but coupled together in a different manner than in FIG. 3B.

FIG. 4 is a perspective view of the same construction elements 12, 50, 70, but the second and third construction elements 12, 50 are now shifted so as not to be connected through aperture 72, but at a midpoint along the planar construction element 70. Thus, the male 58 and female 32 connectors no longer pass through the planar construction element 70, but instead fit in the rounded formations 74 shown in FIG. 3A. A slot 84 is identified in the coupled construction elements 12, 50 for FIG. 5.

Figure 5:
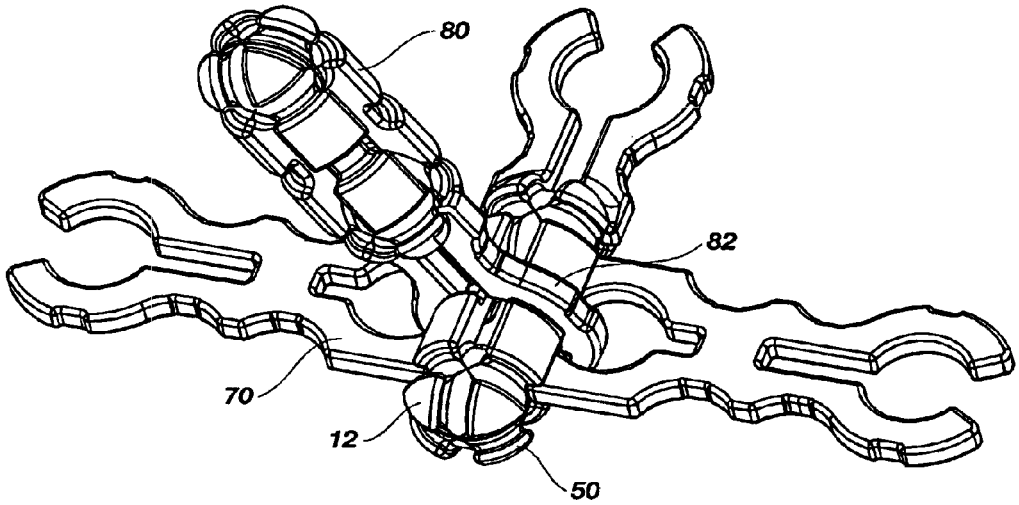
FIG. 5 is a perspective view of multiple construction elements that are coupled together.

FIG. 5 is provided as a perspective view of the coupled construction elements of FIG. 4, but now with additional construction element 80 that is coupled by a C-claw 82 to the slot 84.

Figure 6A:
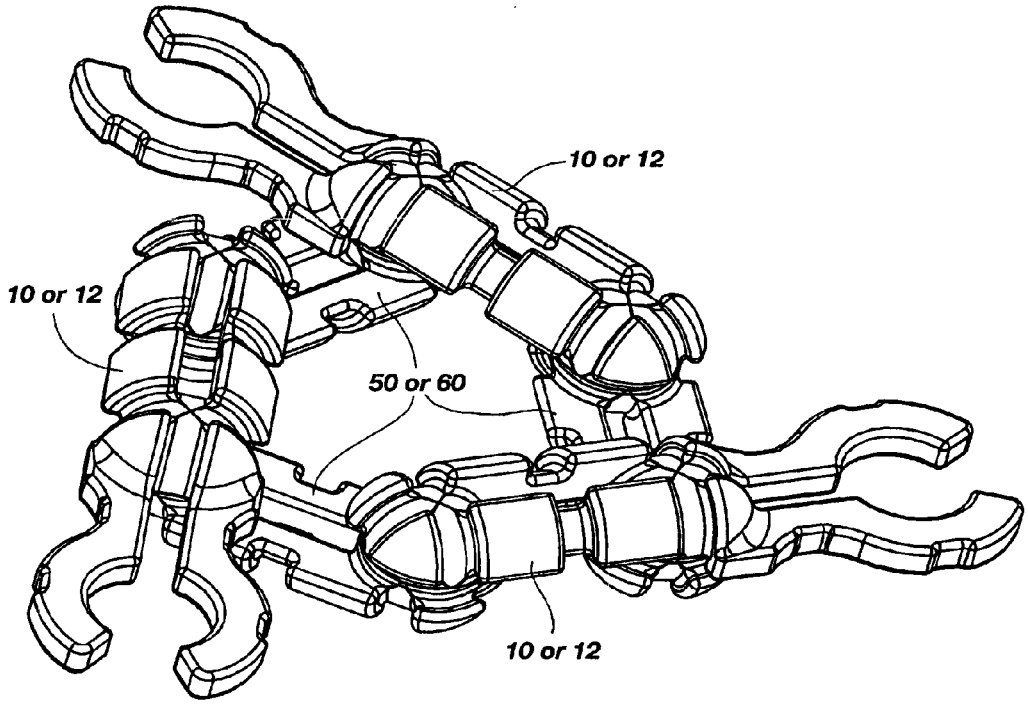
FIG. 6A is a perspective view of multiple construction elements that are coupled together.

FIG. 6A is provided is as a perspective view of six construction elements coupled together in a manner that was suggested previously. For example, the figure can show three first construction elements 10 coupled to three fourth construction elements 60. Likewise, the figure can show three second construction elements 12 coupled to three third construction elements 50. Any single construction element is always coupled to two other complementary construction elements.

Figure 6B:
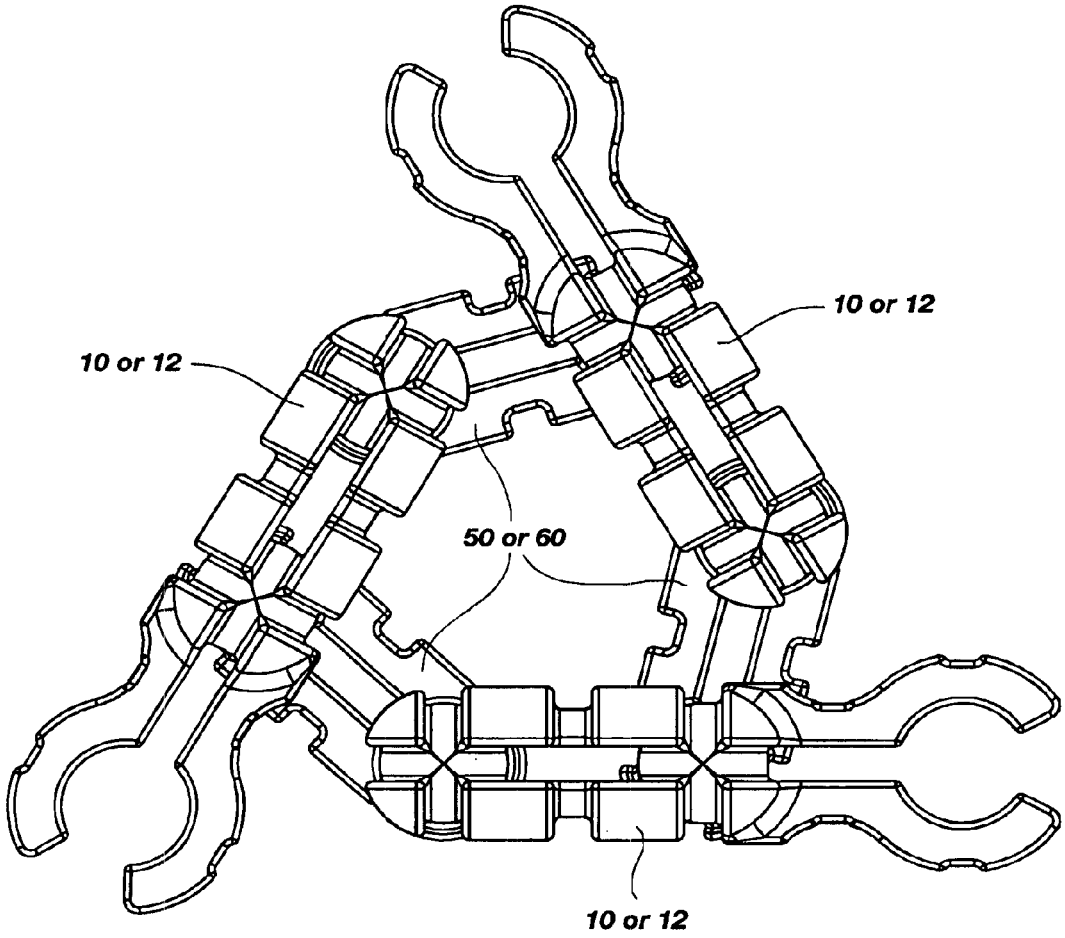
FIG. 6B is a top view of the multiple construction elements that are coupled together in FIG. 6A.

FIG. 6B is a top view of the construction elements shown in FIG. 6A.

Figure 7A:
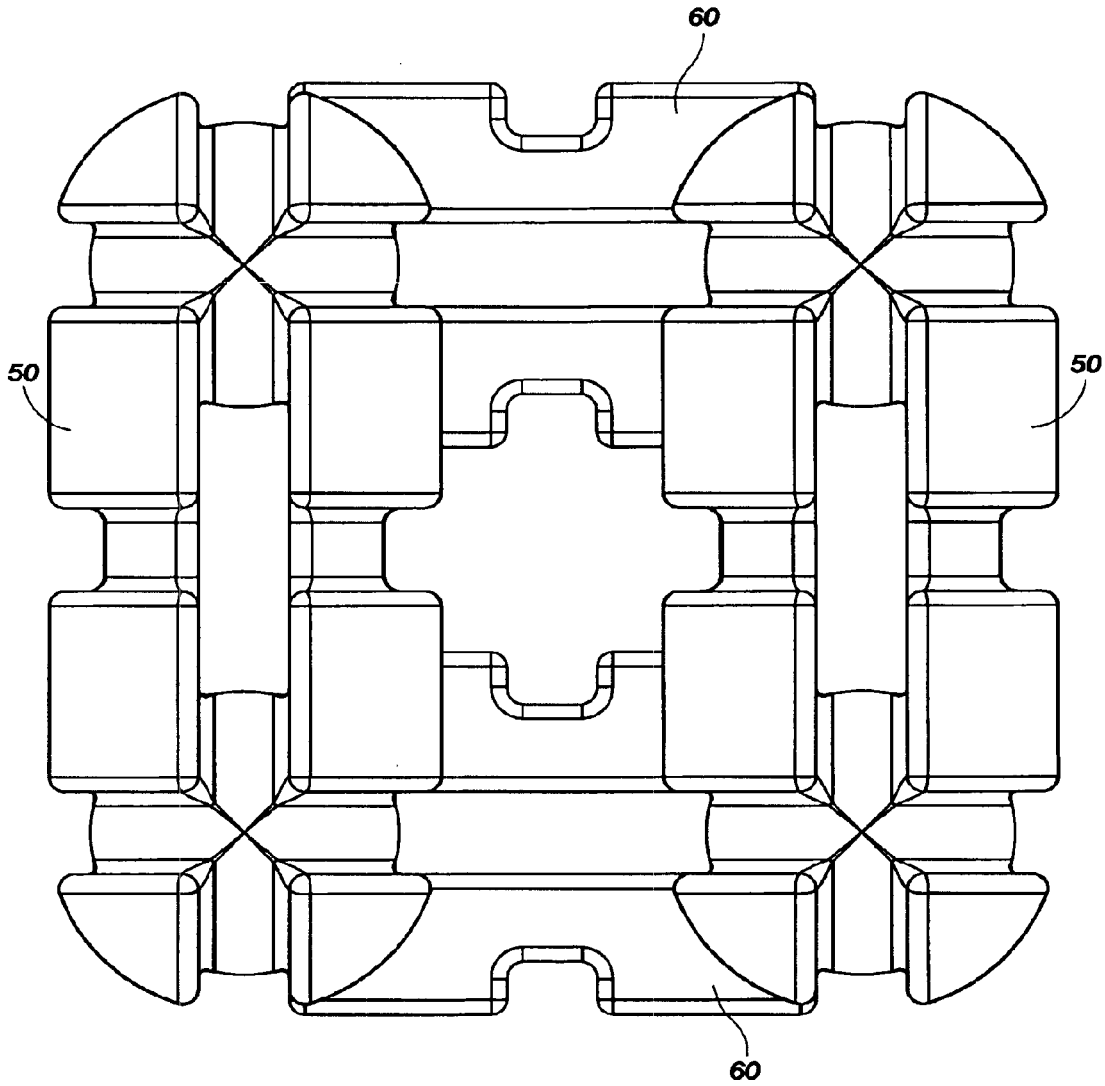
FIG. 7A is a top view of multiple construction elements that are coupled together in a manner that permits sliding engagement about multiple points of rotation.

FIG. 7A is a top view of four construction elements. There are two third construction elements 50, and two fourth construction elements 60.

Figure 7B:
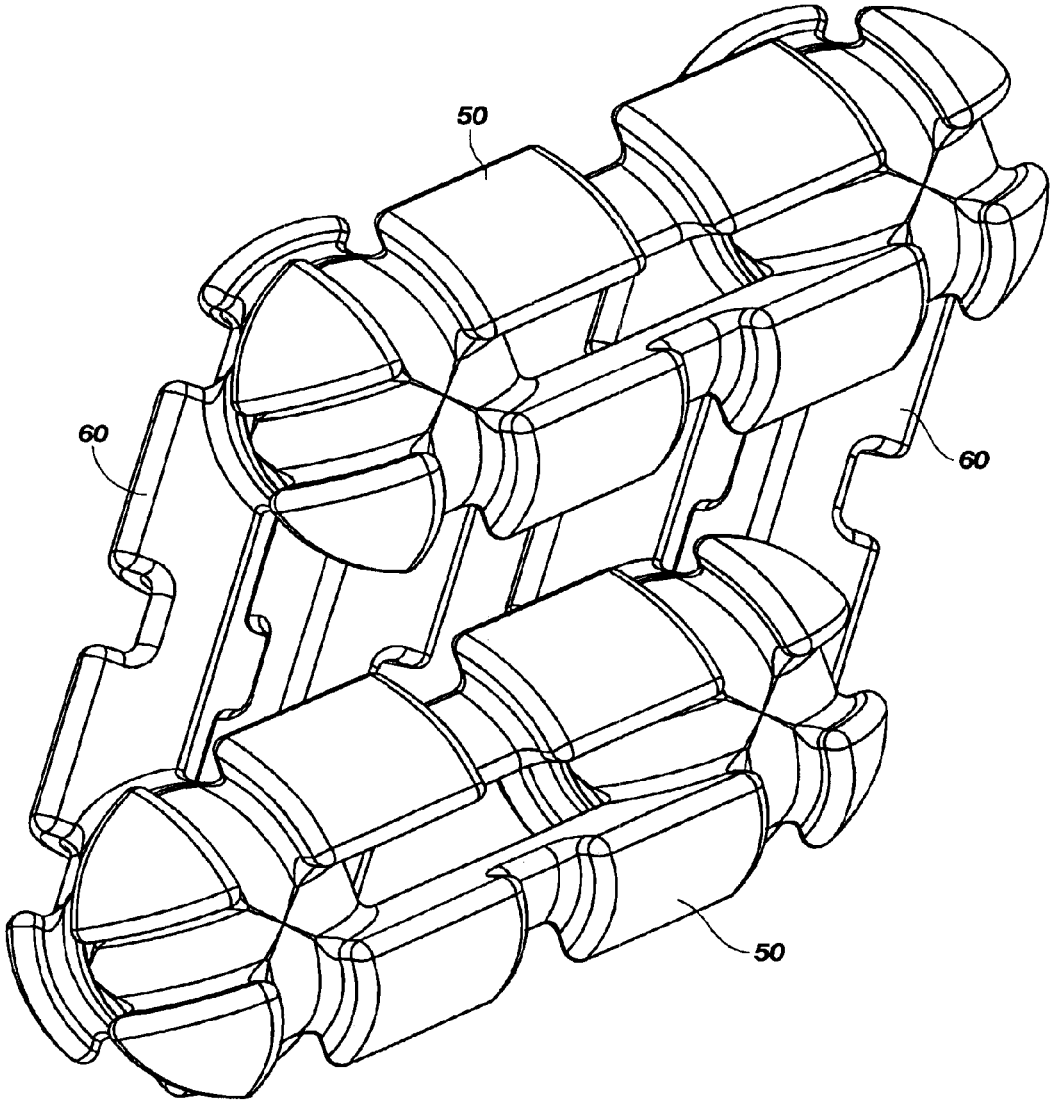
FIG. 7B is a top view of the multiple construction elements that have been rotated with respect to each other at the multiple points of rotation.

FIG. 7B is a top view of the four construction elements of FIG. 7A, wherein the constructions have been pushed so as to rotate at connection points in the corners of the shape. Thus, the connection points are sufficiently loose so as to be in sliding engagement, allowing rotation while still being snapped together.

Figure 8:
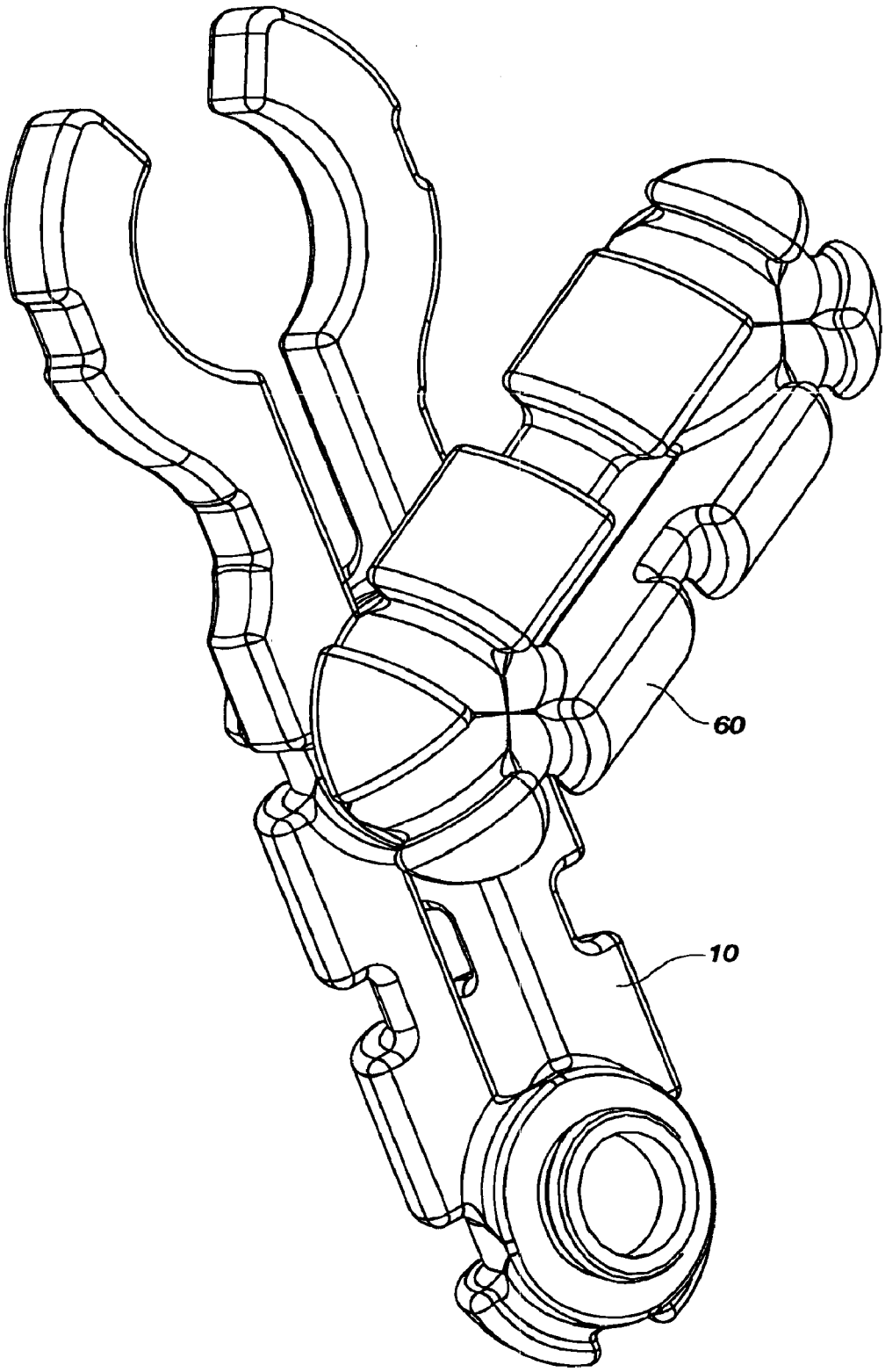
FIG. 8 is a perspective view of two construction elements coupled together.

FIG. 8 is a top view of the first construction element 10 coupled at only one male connector 40 to a complementary female connector 68 in the fourth construction element 60. It should be understood that the construction elements 10, 60 are able to rotate in the same plane with respect to each other, at least until protruding male and female connectors 40, 68 strike an edge of the construction elements.

Figure 9:
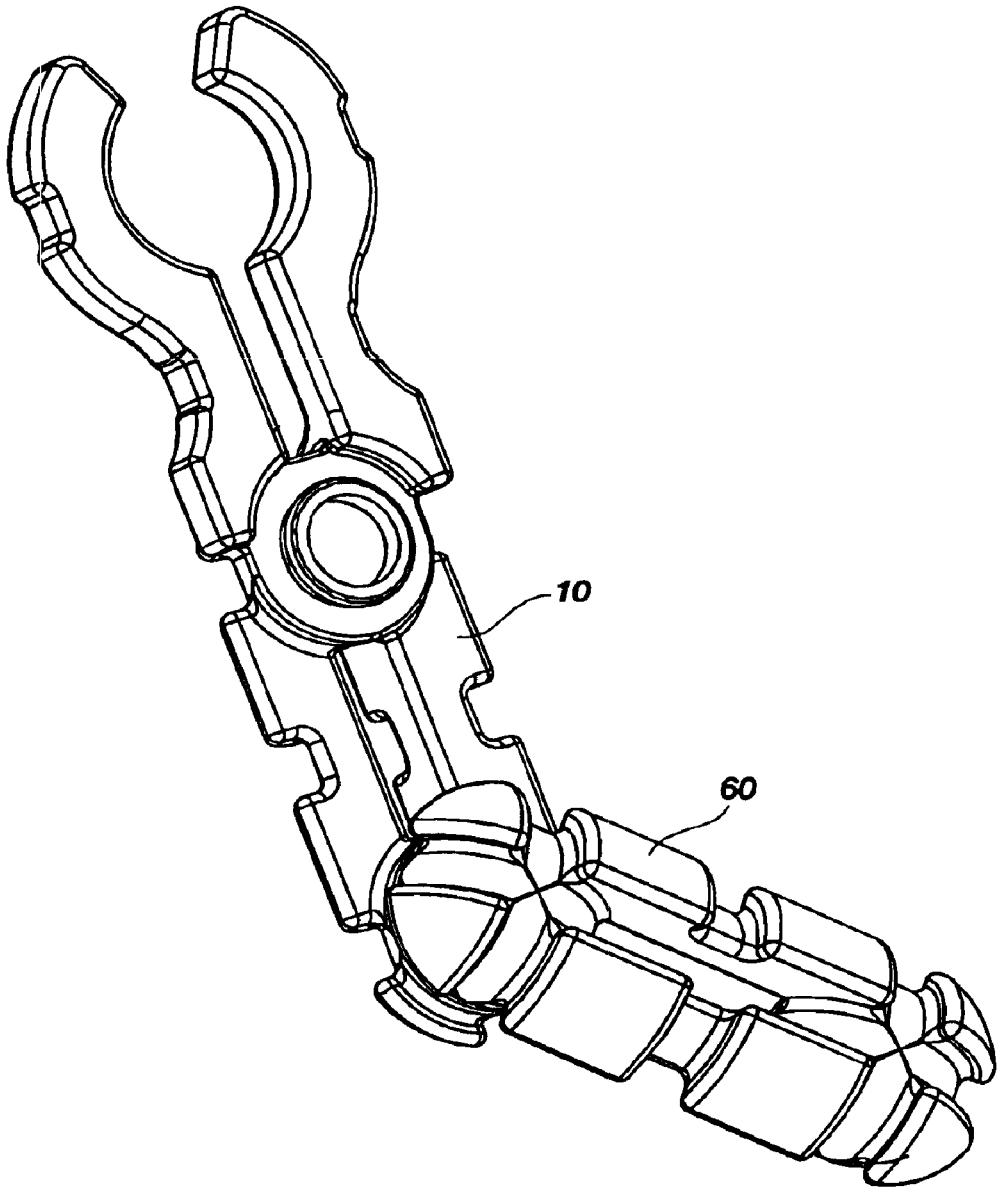
FIG. 9 is a perspective view of the two construction elements of FIG. 8 that have been coupled together at a different location.

FIG. 9 is a top view of the first construction element 10 coupled at a single male connector 40 to a complementary female connector 68 in the fourth construction element 60. What has changed between FIGS. 8 and 9 is that the fourth construction element 60 is now coupled to a different male connector 40 of the first construction element 10. It should be noted that the fourth construction element 60 is now almost able to make a complete rotation with respect to the first construction element 10 when coupled to a male connector 40 on the end of the first construction element.

It should also be observed that there is a gap between any two coupled construction elements between the hemispheres. For example, see the gap identified as 90 in FIG. 3B. These gaps enable planar construction members to be disposed between or coupled to the construction elements 10, 12, 50, 60. These gaps also enable connecting ends such as the C-claws of the first and second construction elements 10, 12 to be coupled to other construction elements.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A first construction toy formed of molded plastic, wherein the first construction toy comprises:

a planar segment in a first plane and formed having a connector at a connecting end along a long axis thereof;

a hemispherical segment coupled to the planar segment opposite a connecting end, wherein the hemispherical segment is aligned with the long axis of the planar segment, wherein the hemispherical segment includes two hemispheres coupled by a joining segment to form a planar side in a second plane, and a hemispherical portion side, and wherein the hemispherical segment includes at least one male connector; and wherein the first plane of the planar segment is offset from the second plane of the hemispherical segment.

2. The first construction toy as defined in claim 1 wherein the at least one male connector of the hemispherical segment further comprises a raised and circular lip disposed on each of the two hemispheres on the planar side, wherein the raised and circular lip is disposed in a third plane that is parallel to the first and the second planes.

3. The first construction toy as defined in claim 2 wherein the first construction toy further comprises the first plane being disposed above the third plane, and the third plane being disposed above the second plane.

4. The first construction toy as defined in claim 1 wherein joining segment is further comprised of two joining segments, wherein the two joining segments have a slot disposed therebetween.

5. The first construction toy as defined in claim 1 wherein the two hemispheres of the hemispherical segment are further comprised of at least one indented slot around the hemispherical side, wherein the at least one indented slot is perpendicular to the long axis of the planar segment.

6. The first construction toy as defined in claim 1 wherein the two hemispheres of the hemispherical segment are further comprised of at least one indented slot around the hemispherical side, wherein the at least one indented slot is parallel to the long axis of the planar segment.

7. The first construction toy as defined in claim 1 wherein the joining segment is further comprised of at least one indented slot that is perpendicular to the long axis of the planar segment.

8. The first construction toy as defined in claim 1 wherein the connector of the planar segment is further comprised of a C-claw shape on an end thereof.

9. The first construction toy as defined in claim 8 wherein the planar segment is further comprised of a slot along the long axis of the planar segment, beginning at a midpoint of an arc that forms the C-claw shape, and extending towards the hemispherical segment, wherein the slot is perpendicular to the first plane of the planar segment.

10. The first construction toy as defined in claim 9 wherein the C-claw shape further comprises an indented slot in each arm of the C-claw shape, wherein the indented slot is perpendicular to the long axis of the planar segment.

11. A second construction toy formed of molded plastic, wherein the second construction toy comprises:

a planar segment in a first plane and formed having a connector at a connecting end along a long axis thereof;

a hemispherical segment coupled to the planar segment opposite a connecting end, wherein the hemispherical segment is aligned with the long axis of the planar segment, wherein the hemispherical segment includes two hemispheres coupled by a joining segment to form a planar side in a second plane, and a hemispherical portion side, and wherein the hemispherical segment includes at least one female connector; and wherein the first plane of the planar segment is offset from the second plane of the hemispherical segment.

12. The second construction toy as defined in claim 11 wherein the at least one female connector of the hemispherical segment further comprises a raised and circular column disposed on each of the two hemispheres on the planar side, wherein each of the raised and circular columns has an indentation disposed along an inside circumference thereof.

13. The second construction toy as defined in claim 12 wherein the first construction toy further comprises the first plane being disposed above the third plane, and the third plane being disposed above the second plane.

14. The second construction toy as defined in claim 11 wherein joining segment is further comprised of two joining segments, wherein the two joining segments have a slot disposed therebetween.

15. The second construction toy as defined in claim 11 wherein the two hemispheres of the hemispherical segment are further comprised of at least one indented slot around the hemispherical side, wherein the at least one indented slot is perpendicular to the long axis of the planar segment.

16. The second construction toy as defined in claim 11 wherein the two hemispheres of the hemispherical segment are further comprised of at least one indented slot around the hemispherical side, wherein the at least one indented slot is parallel to the long axis of the planar segment.

17. The second construction toy as defined in claim 11 wherein the joining segment is further comprised of at least one indented slot that is perpendicular to the long axis of the planar segment.

18. The second construction toy as defined in claim 11 wherein the connector of the planar segment is further comprised of a C-claw shape on an end thereof.

19. The second construction toy as defined in claim 18 wherein the planar segment is further comprised of a slot along the long axis of the planar segment, beginning at a midpoint of an arc that forms the C-claw shape, and extending towards the hemispherical segment, wherein the slot is perpendicular to the first plane of the planar segment.

20. The second construction toy as defined in claim 19 wherein the C-claw shape further comprises an indented slot in each arm of the C-claw shape, wherein the indented slot is perpendicular to the long axis of the planar segment.

21. A third construction toy formed of molded plastic, wherein the third construction toy comprises:

a hemispherical segment including two hemispheres coupled by a joining segment to form a planar side in a first plane along a long axis, and a hemispherical portion side, and wherein the hemispherical segment includes at least one male connector having an edge that is disposed in a second plane that is parallel to the first plane; and wherein the first plane of the planar side is offset from the second plane of the male connector.

22. The third construction toy as defined in claim 21 wherein the at least one male connector of the hemispherical segment further comprises a raised and circular lip disposed on each of the two hemispheres on the planar side.

23. The third construction toy as defined in claim 22 wherein the third construction toy further comprises the second plane being disposed above the first plane.

24. The third construction toy as defined in claim 21 wherein joining segment is further comprised of two joining segments, wherein the two joining segments have a slot disposed therebetween.

25. The third construction toy as defined in claim 21 wherein the two hemispheres of the hemispherical segment are further comprised of at least one indented slot around the hemispherical side, wherein the at least one indented slot is perpendicular to the long axis.

26. The third construction toy as defined in claim 21 wherein the two hemispheres of the hemispherical segment are further comprised of at least one indented slot around the hemispherical side, wherein the at least one indented slot is parallel to the long axis.

27. The third construction toy as defined in claim 21 wherein the joining segment is further comprised of at least one indented slot that is perpendicular to the long axis.

28. A fourth construction toy formed of molded plastic, wherein the fourth construction toy comprises:

a hemispherical segment including two hemispheres coupled by a joining segment to form a planar side in a first plane along a long axis, and a hemispherical portion side, and wherein the hemispherical segment includes at least one female connector having an edge that is disposed in a second plane that is parallel to the first plane; and wherein the first plane of the planar side is offset from the second plane of the female connector.

29. The fourth construction toy as defined in claim 28 wherein the at least one female connector of the hemispherical segment further comprises a raised and circular column disposed on each of the two hemispheres on the planar side, wherein each of the raised and circular columns has an indentation disposed along an inside circumference thereof.

30. The fourth construction toy as defined in claim 29 wherein the fourth construction toy further comprises the second plane being disposed above the first plane.

31. The fourth construction toy as defined in claim 28 wherein joining segment is further comprised of two joining segments, wherein the two joining segments have a slot disposed therebetween.

32. The fourth construction toy as defined in claim 28 wherein the two hemispheres of the hemispherical segment are further comprised of at least one indented slot around the hemispherical side, wherein the at least one indented slot is perpendicular to the long axis.

33. The fourth construction toy as defined in claim 28 wherein the two hemispheres of the hemispherical segment are further comprised of at least one indented slot around the hemispherical side, wherein the at least one indented slot is parallel to the long axis.

34. The fourth construction toy as defined in claim 28 wherein the joining segment is further comprised of at least one indented slot that is perpendicular to the long axis.

* * * * *